United States Patent [19]

Bakermans et al.

[11] Patent Number: 4,934,173

[45] Date of Patent: Jun. 19, 1990

[54] STAMPING AND FORMING MACHINE HAVING TOGGLES FOR RECIPROCATING THE TOOLING ASSEMBLIES

[75] Inventors: Johannes C. W. Bakermans, Harrisburg; Christopher K. Brown, Camp Hill; Dimitry G. Grabbe, Middletown, all of Pa.

[73] Assignee: AMP Incorporated, Harrisburg, Pa.

[21] Appl. No.: 325,583

[22] Filed: Mar. 17, 1989

[51] Int. Cl.[5] ..... B21J 9/18

[52] U.S. Cl. ..... 72/451; 72/450; 72/452; 72/407; 100/264; 100/286; 100/272

[58] Field of Search ..... 100/272, 281, 282, 286, 100/264; 72/402, 399, 401, 416, 450, 451, 452, 407

[56] References Cited

U.S. PATENT DOCUMENTS

| | | | |
|---|---|---|---|
| 2,633,765 | 4/1953 | Glasner | 72/451 |
| 3,488,990 | 1/1970 | Brown | 100/272 |
| 3,620,067 | 11/1971 | Ross | 100/272 |
| 3,661,008 | 5/1972 | Richardson | 100/286 |
| 3,926,033 | 12/1975 | Forichon | 100/272 |
| 4,133,260 | 1/1979 | Gundal | 100/272 |
| 4,448,119 | 5/1984 | Williamson | 100/286 |
| 4,497,196 | 3/1989 | Bakermans et al. | 72/405 |
| 4,660,452 | 4/1987 | Leinhaas | 100/286 |
| 4,809,529 | 3/1989 | Shinozawa et al. | 72/451 |

FOREIGN PATENT DOCUMENTS

| | | | |
|---|---|---|---|
| 737768 | 8/1969 | Belgium | 72/451 |
| 2028477 | 12/1971 | Fed. Rep. of Germany | 72/451 |
| 2819729 | 11/1979 | Fed. Rep. of Germany | 100/281 |
| 1004149 | 3/1983 | U.S.S.R. | 100/286 |

*Primary Examiner*—David Jones

*Attorney, Agent, or Firm*—James M. Trygg

[57] ABSTRACT

Stamping and forming machine of the type having opposed tooling assemblies which are reciprocable towards and away from each other has toggle mechanisms for moving the tooling assemblies along their paths of reciprocation. Each toggle mechanism has one toggle link pivoted to a tooling assembly and another toggle link pivoted at a fixed pivot location. The fixed location pivots are adjustable in order to control the position of the tooling assemblies when they are in their closed positions. Additionally, adjustable wear plates are provided in the passageway in which the tooling assemblies are mounted. Advantages achieved include reduced manufacturing cost for the machine, potential for high operating speeds, and compactness when desired.

7 Claims, 4 Drawing Sheets

Figure 1:
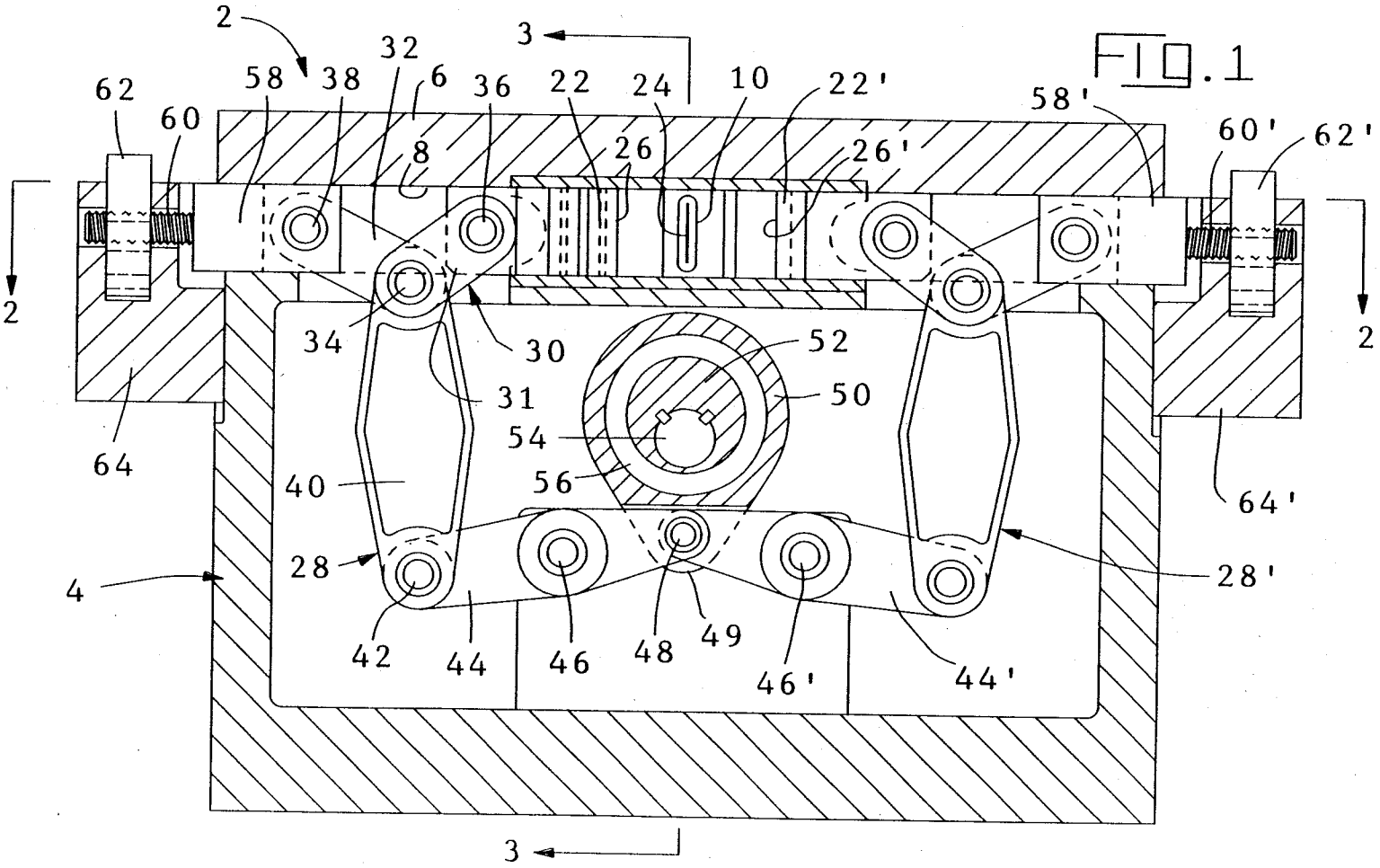

STAMPING AND FORMING MACHINE HAVING TOGGLES FOR RECIPROCATING THE TOOLING ASSEMBLIES

FIELD OF THE INVENTION

This invention relates to stamping and forming machines of the type described in U.S. Pat. No. 4,497,196. The invention is particularly directed to a machine which can be relatively compact and which has adjustment features for controlling the strokes of the tooling assemblies and which has adjustable bearing surfaces.

BACKGROUND OF THE INVENTION

U.S. Pat. No. 4,497,196 (which is hereby incorporated by reference in its entirety) describes a stamping and forming machine having one or more machine modules in side-by-side relationship. Each module has two tooling assemblies therein which are reciprocable towards and away from each other. The strip material is fed along a strip feed path which extends between the tooling assemblies and through the module so that stamping and forming operations are performed on the strip material in the module.

Machines of the type described in the above-identified U.S. patent offer several advantages over conventional stamping and forming machines of the type in which a conventional press is used in conjunction with a die assembly composed of a die shoe having the forming tooling therein. For example, each of the modules of the machine (if more than one) contains tooling for performing only one or two operations on the strip material and the tooling assemblies are of relatively simple construction so that there is no necessity to produce a complicated and extremely expensive die assembly as with prior art stamping and forming machines. An advantage is also achieved by virtue of the fact that both of the tooling assemblies in each module are moved towards and away from each other and the machines are thereby dynamically balanced. The stroke of the tooling assemblies can be relatively short, as compared with prior art stamping presses, and the power requirements are thereby reduced. The amount of noise produced by stamping and forming machines in accordance with the above-identified U.S. patent is also much lower than that produced by conventional stamping machines.

The present invention is directed to the achievement of an improved stamping and forming machine of the general type described in U.S. Pat. No. 4,497,196 which can, if desired, be more compact than machines of the type described in the patent. The invention is further directed to the achievement of a machine which can be produced at reduced cost and which can be used to advantage under circumstances where relatively simple operations are being performed on relatively thin strip material, for example, simple blanking operations or simple forming operations which do not require a large capacity machine.

THE INVENTION

The invention comprises an apparatus for performing operations, such as punching and forming operations, on strip material. One embodiment of the apparatus comprises first and second tooling assemblies and tooling assembly actuating means for reciprocating the tooling assemblies towards and away from each other between an open position and a closed position. The tooling assemblies are remote from each other in their open positions and are proximate to each other in their closed positions. Guide means are provided for guiding the tooling assemblies along their paths of reciprocation and the strip material is fed along a strip feed path which extends transversely of the paths of reciprocation so that the tooling assemblies perform operations on the strip during each operating cycle. The apparatus is characterized in that the actuating means comprises first and second toggle mechanisms for the first and second tooling assemblies respectively. Each toggle mechanism comprises two toggle links which are pivotally connected to each other at a knee joint. The toggle links have remote ends which are spaced from the knee joint. One of the links of each toggle mechanism has its remote end pivoted to its associated tooling assembly and the other toggle link has its remote end pivoted at a fixed pivot location whereby when the toggle mechanisms are broken, the tooling assemblies are in their open positions and when the toggle mechanisms are moved to their straightened positions, the tooling assemblies are moved to their closed positions. In accordance with one embodiment, the means for straightening and breaking each of the toggle mechanisms comprises a connecting link and a rocker arm. The connecting link is pivotally connected at one end thereof to the knee joint of its associated toggle mechanism and is pivotally connected at the other end thereof to one end of its associated rocker arm. Each rocker arm is pivoted intermediate its ends for rocking motion and has its other end pivotally connected to a power source means which imparts rocking motion to the rocking arm. The power source means advantageously comprises a single power shaft having eccentrics thereon, the other ends of each rocker arm being pivotally connected to the eccentrics.

In accordance with a further embodiment, the fixed pivot locations, to which the remote ends of the other toggle links are pivoted, are adjustable towards and away from each other so that the spacing between the first and second tooling assemblies, when they are in their closed positions, can be adjusted. In accordance with a further embodiment, the guide means for the tooling assemblies comprises a housing having a passageway therein, the tooling assemblies being in the passageway. The tooling assemblies and the passageway have non-circular cross-sections and the passageway has wear plates therein against which the tooling assemblies bear. The wear plates are adjustable in directions which are normal to the directions of reciprocation of the tooling assemblies so that the bearing surfaces, which are surfaces of the wear plates, can be precisely located thereby accurately to control the movement of the tooling assemblies in the passageway.

THE DRAWING FIGURES

Figure 2:
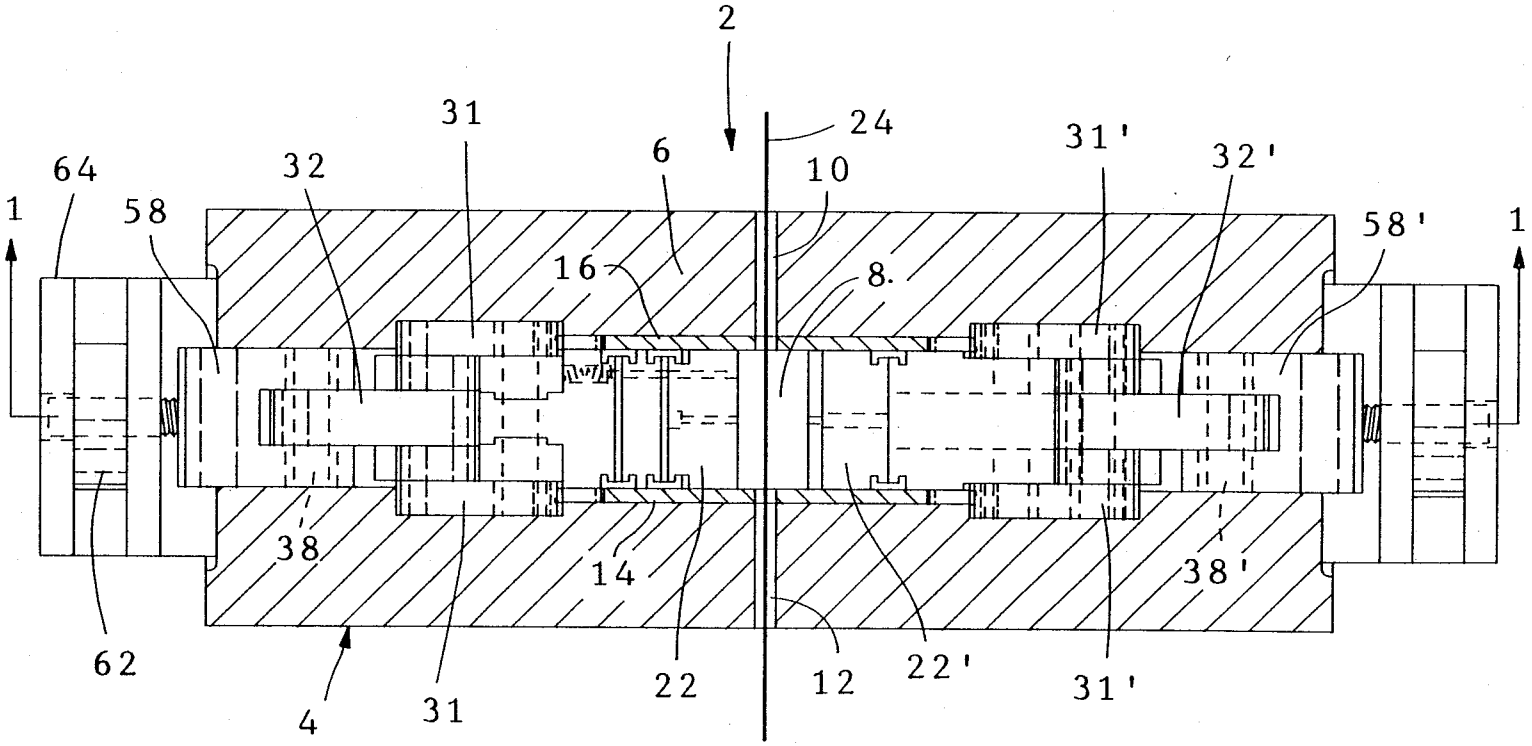

FIG. 1 is a sectional frontal view of an apparatus in accordance with the invention, this view being taken along the section lines 1—1 of FIG. 2.

Figure 3:
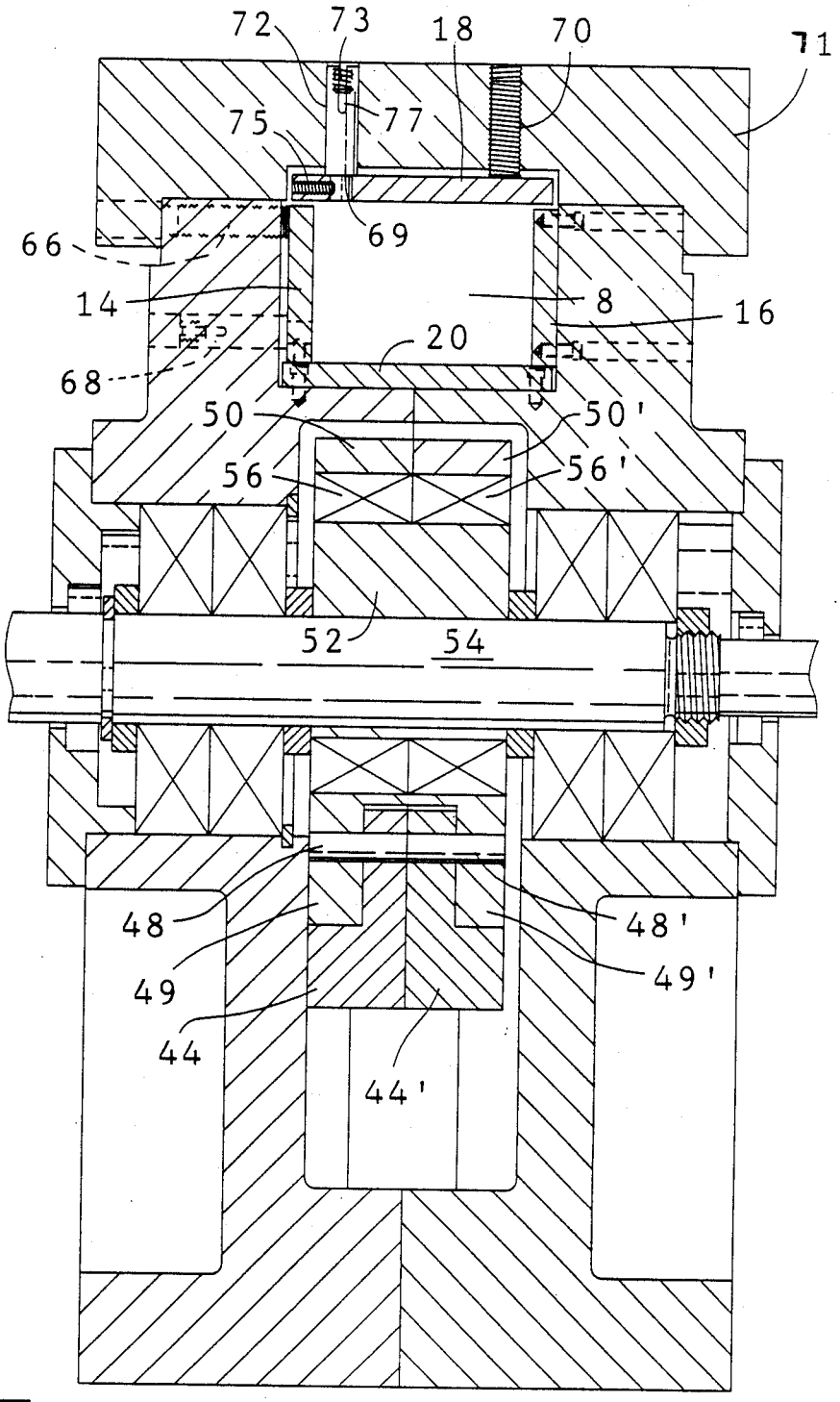

FIGS. 2 and 3 are views looking in the direction of the arrows 2—2 and 3—3 of FIG. 1.

Figure 4:
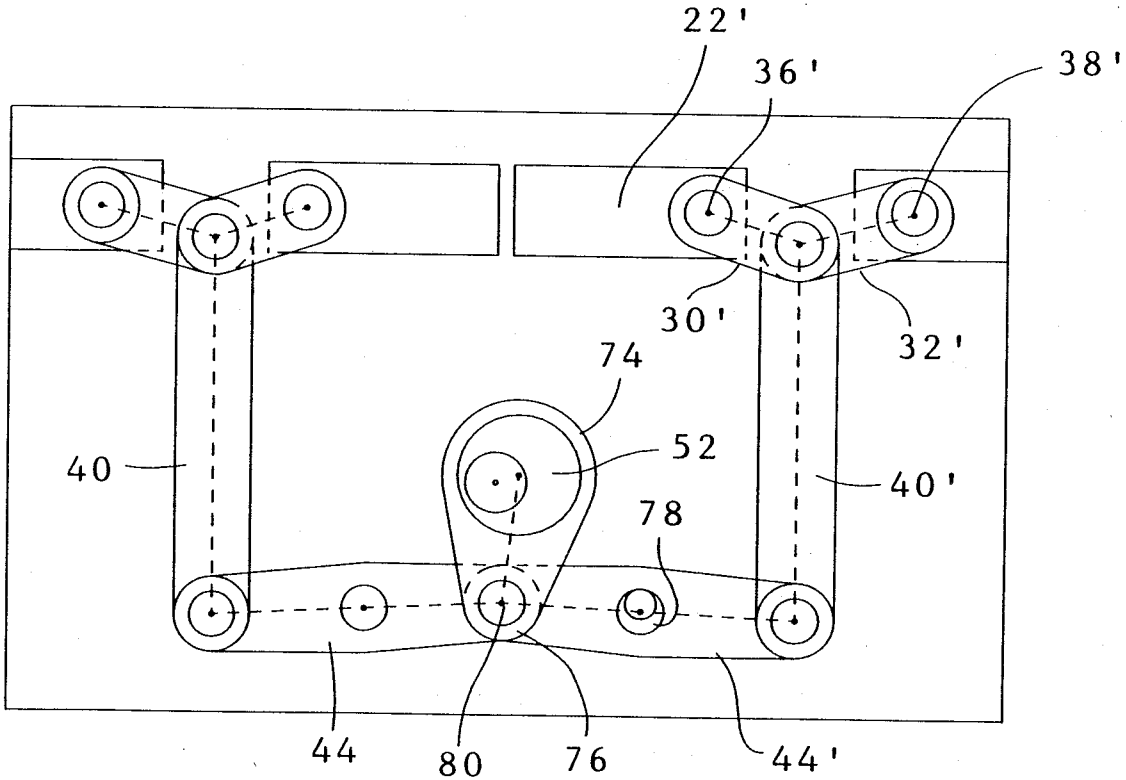

FIG. 4 is a diagrammatic view of an alternative embodiment.

THE DISCLOSED EMBODIMENT

A stamping and forming machine 2 in accordance with the invention comprises a composite frame and housing 4 having an upper portion 6 through which a passageway 8 extends. The machine is shown in an orientation such that the passageway extends horizontally and the tooling assemblies 22, 22' move along horizontal paths in the passageway. This is the preferred orientation for the machine, although it could be used in other orientations.

The strip material 24 is fed through an inlet slot 10, into and through the passageway 8 and from the passageway through an outlet slot 12, the material being in a vertical plane as shown in FIG. 2. The passageway is lined with spaced-apart vertical wear plates 14, 16 and spaced-apart horizontal wear plates 18, 20 against which the tooling assemblies bear when they move towards and away from each other.

First and second tooling assemblies 22, 22' are provided in the passageway and have opposed faces 26, 26' which are proximate to each other when the tooling assemblies are in their closed position and which are remote from each other when the tooling assemblies are in their open positions. The tooling assemblies and the passageway 8 have rectangular cross-sections and the tooling assemblies are preferably of the type described in detail in application Ser. No. 074,656, filed July 17, 1987, now U.S. Pat. No. 4,819,476 which is hereby incorporated by reference in its entirety. The tooling assemblies will contain conventional stamping and forming tooling such as punches, die openings for the punches, swaging tools, anvils, and similar forming tools.

The tooling assemblies 22, 22' are reciprocated towards and away from each other by similar actuating means shown on the left and the right in FIG. 1. Each of these actuating means comprises a toggle mechanism 28, 28' and means for straightening and breaking the toggle mechanisms as described below. Since the actuators for the tooling assemblies are similar to each other, only the actuating means 28 on the left in FIG. 1 will be described in detail and the same reference numerals, differentiated by prime marks, will be used to identify corresponding structural elements on the right and on the left in FIG. 1.

The toggle mechanism 28 for the left-hand tooling assembly 22 comprises a composite toggle link 30 and a toggle link 32. The composite link 30 comprises two spaced-apart link sections 31 which are pivoted at 36 to the tooling assembly 22. The link 32 has one end which is pivoted at 38 to a fixed pivot location which is adjustable as described below. The toggle links have common ends which are pivoted to each other at a knee joint 34.

The toggle mechanism 28 is straightened and broken by means of a connecting rod 40 which is pivoted at its upper end to the knee joint 34 and which is pivotally connected at its lower end 42 to a rocker arm 44. The rocker arm is pivoted intermediate its ends at 46 to a fixed pivot and has its right-hand end, as viewed in FIG. 1, pivotally connected at 48 to an ear 49 which extends from a collar 50. The collar 50 is mounted, by means of roller bearings 56, on an eccentric 52 which in turn is keyed to a shaft 54. During continuous rotation of the shaft 54, the collar 50 is moved vertically as viewed in FIG. 1 but is allowed to move laterally to some extent in order to accommodate the arcuate movement of the pivot 48 when the rocker arm is oscillated about its intermediate fixed pivotal axis 46. The toggle 28 is thereby repetitively straightened and broken and the tooling assembly 22 is reciprocated.

A separate collar is provided for the rocker arm 44' and is mounted on the eccentric 52 in the same manner as is the collar 50. The end of the rocker arm 44' is pivotally connected to an ear on the separate collar. It is necessary to provide two collars for the reason that the pivotal axis 48 moves along an arcuate path with the pivotal axis 46 as a center while the pivotal connection 48' moves along an arcuate path that has the pivotal axis 46' of the rocker arm 44 as a center.

In order to permit precise control of the positions of the tooling assemblies 22, 22' when they are in their closed positions, that is when their faces 26, 26' are proximate to each other and the tooling carried by the tooling assemblies is in engagement with the strip material, the fixed pivot locations 38, 38' are adjustable as will now be described.

The ends of the links 32, 32' which are remote from the pivotal axes 34, 34' are received in recesses in yoke members 58, 58'. These yoke members are slidably and adjustably contained in the passageway 8 adjacent to the sides of the frame. Each yoke member has a screw 60, 60' therein which extends outwardly beyond the sides of the housing. Each screw extends through a threaded adjusting nut 62, 62' which is captured in a recess in a mounting block 64, 64', the mounting blocks being secured to the side surfaces of the frame. If it is required that the positions of the tooling assemblies 22, 22' be adjusted when these tooling assemblies are in their closed positions, it is merely necessary to rotate one or both of the adjusting nuts 62, 62' until the required adjustments have been made.

The wear plates 14, 16, 18, 20 extend for a substantial distance on each side of the central axis of the machine as shown in FIG. 1 and their opposed surfaces provide the bearing surfaces for the tooling assemblies 22, 22'. In the disclosed embodiment, the wear plates 14 and 18 are adjustably mounted in the frame by means of adjusting screws and guide pins which extend into the wear plates and through the housing. Also, there are slight gaps between the corners of the wear plates 14 and 18 and between the corners of wear plates 16 and 18. This gap is necessary in order to permit such adjustment. The amount by which the wear plates would ordinarily be adjusted is very slight but the provision of this wear plate adjustment feature reduces the manufacturing cost of the machine significantly and contributes to precise control of the tooling assemblies so that products produced from the strip material can be held to precise dimensional tolerances.

FIG. 3 shows details of an adjusting screw 70 and a guide pin 72 for the wear plate 18. The screw extends through a threaded hole in the cover plate 71 and bears against the upwardly facing surface of the wear plate 18. The guide pin 72 has a reduced diameter lower end which extends into a hole in the wear plate so that the shoulder 69 of the guide pin bears against the plate 18. The pin is securely locked in its position by a set screw 75. In order to lock the pin in a position of adjustment, two diametric slots are provided in the upper end of the pin, one of these slots being shown at 77. A concentric tapped hole is provided in the upper end of the pin and a screw 73 is threaded into this hole, the diameter of the screw being such that the upper portion of the pin in the vicinity of the slots is flexed outwardly by the screw. When the position of the wear plate is to be adjusted, the screw 73 is removed to permit the wear plate to move in response to adjustment of the adjusting screw 70.

It will be understood that several screws and guide pins are provided in cover member 71 at spaced-apart locations as required. Similar screws and pins 66, 68 are provided for the vertically extending plate 14.

FIG. 4 shows an alternative embodiment which requires only a single collar 74 on the eccentric 52 rather than two collars as required in the embodiment described above. The single collar 74 has an ear 76 to which the inner ends of both of the rocker arms 44, 44' are pivoted. In this embodiment, the intermediate pivot 78 for the rocker arm 44' is an eccentric pivot while the pivotal axis for the rocker arm 44 is a fixed pivot as described above. During rotation of the power shaft, the pivotal axis 80 of the ends of the rocker arms and the ear 76 will follow an arcuate path with the axis of the intermediate pivot 46 as a center. The pivoted end of the rocker arm 44' is permitted to move along this arcuate path by virtue of the provision of the eccentric intermediate pivot 78.

Several advantages are achieved in the practice of the invention as a result of the novel features described above. As previously mentioned, the machine, in accordance with the present invention, can be relatively more compact, if desired, than machines of the general type described in U.S. Pat. No. 4,497,196. Compactness can be achieved by virtue of the provision of the toggle mechanisms for reciprocating the tooling assemblies rather than the lever system described in the above-identified patent. The toggle mechanisms permit the achievement of a stroke of up to 0.300 inches (7.66 mm) for each of the tooling assemblies 22, 22' notwithstanding the fact that the toggle links will have a length of only about 1.5 to 2.0 inches (38 to 51 mm). The connecting rods, 40, 40' for a typical machine will have a length of only about 6 inches (152 mm) and the rocker arms they have a length of 4.75 inches (121 mm). The overall dimensions of the machine as described above can therefore be no more than about 10 inches (254 mm) in height and 16 inches (406 mm) in width. Nevertheless, a relatively long stroke 0.30 inches for each tooling assembly 22) can be achieved if required.

The provisions of the adjustable wear plates 14, 18 is highly advantageous in that it is unnecessary to carry out precise machining operations on the surfaces of the passageway 8 in the composite frame. As shown in FIG. 3, the frame and housing can be formed of several machined sections which are bolted together. The surfaces, however, which define the passageway need not be precisely machined since final adjustment of the wear plates will determine the exact final locations of the bearing surfaces and dimensions of the passageway. When the machine is placed in service, of course, any wear on these bearing plates can be taken up by adjustment of the wear plates thereby avoiding the necessity of a substantial rebuilding procedure after prolonged usage.

The provision of the adjustable pivots 38, 38' for the toggle links 32, 32' is highly advantageous, particularly where operations such as swaging or coining operations are being carried out. In such operations, a tool on one of the tooling assemblies 22, 22' will be against a complementary anvil or the like on the other tooling assembly when the two tooling assemblies are in their closed positions. When a swaging or coining operation is being performed on the material, it is essential that the positions of the swaging or coining tooling and the corresponding anvils be precisely located in order to achieve a high degree of dimensional precision in the finished parts. Such precise location of the tooling is achieved easily by virtue of the adjustable pivots 38, 38'.

It will be apparent by the foregoing that the principles of the invention permit the achievement of an extremely compact stamping and forming machine which can be produced at a relatively low cost, as compared with conventional stamping and forming tooling assemblies, without sacrifice of dimensional precision or operating speed.

We claim:

1. Apparatus for performing operations, such as punching and forming operations, on strip material, the apparatus comprising first and second tooling assemblies, tooling assembly actuating means for reciprocating the first and second tooling assemblies towards and away from each other between an open position and a closed position, the tooling assemblies being remote from each other in their open positions and being proximate to each other in their closed positions, guide means for guiding the tooling assemblies along their paths of reciprocation, the strip material being fed along a strip feed path which extends transversely of the paths of reciprocation so that the tooling assemblies perform operations on the strip material, the apparatus being characterized in that:

the actuating means comprises first and second toggle mechanisms for the first and second tooling assemblies respectively, and means for straightening and breaking each of the toggle mechanisms, each toggle mechanism comprising two toggle links which are pivotally connected to each other at a knee joint, the toggle links having remote ends which are spaced from the knee joint, one of the links of each toggle mechanism having its remote end pivoted to its associated tooling assembly, the other toggle link of each toggle mechanism having its remote end pivoted at a fixed pivot location, the means for straightening and breaking each of the toggle mechanisms comprising a connecting link and a rocker arm, the connecting link being pivotally connected at one end thereof to the knee joint of its associated toggle mechanism and being pivotally connected at the other end thereof to one end of its associated rocker arm, each rocker arm being pivoted intermediate its ends for rocking motion, the other end of each rocker arm being pivotally connected to a power source means which imparts rocking motion to the rocker arm whereby, when the toggle mechanisms are broken, the tooling assemblies are in their open position, and when the toggle mechanisms are moved to their straightened positions, the tooling assemblies are moved to their closed positions.

2. Apparatus as set forth in claim 1 characterized in that the power source means comprises a single power shaft having eccentric means thereon, the other end of each rocker arm being pivotally connected to the eccentric means.

3. Apparatus as set forth in claim 2 characterized in that the fixed pivot locations to which the remote ends of the other toggle links are pivoted are adjustable towards and away from each other whereby the spacing between the first and second tooling assemblies, when they are in their closed positions, can be adjusted.

4. Apparatus as set forth in claim 2 characterized in that the eccentric means comprises first and second eccentrics which are mounted on the power shaft, the first eccentric being pivotally connected to the other end of the rocker arm of the first toggle mechanism, the second eccentric being pivotally connected to the other end of the rocker arm of the second toggle mechanism.

5. Apparatus as set forth in claim 2 characterized in that the eccentric means comprises a single eccentric which is mounted on the power shaft, the other end of each of the rocker arms being pivotally connected to the single eccentric, one of the rocker arms being pivoted intermediate its ends on an eccentric pivot.

6. Apparatus as set forth in claim 3 characterized in that the first and second tooling assemblies comprise first and second rams which are in opposed relationship, the guide means comprising a housing having a ram-receiving passageway therein, the rams and the passageway having non-circular cross-sections, the passageway having wear plates therein against which the rams bear, the wear plates being adjustable in directions which are normal to the directions of reciprocation of the tooling assemblies.

7. Apparatus as set forth in claim 6 characterized in that each of the rams has a rectangular cross-section and four wear plates are provided, two of the wear plates being adjustable wear plates, the adjustable wear plates being adjacent to each other and being in planes which extend normally of each other.

* * * * *